US005311690A

United States Patent [19]

Batten

[11] Patent Number: 5,311,690

[45] Date of Patent: May 17, 1994

[54] IDENTIFICATION TAG

[76] Inventor: Douglas R. Batten, R.R. #1, Box 280, Crozet, Va. 22932

[21] Appl. No.: 753,830

[22] Filed: Sep. 3, 1991

[51] Int. Cl.[5] ..... G09F 3/18

[52] U.S. Cl. ..... 40/642; 40/664

[58] Field of Search ..... 40/642, 664, 665, 299; 24/16 PB, 30.5 P

[56] References Cited

U.S. PATENT DOCUMENTS

| | | | |
|---|---|---|---|
| 1,776,074 | 9/1930 | Kondolf . | |
| 3,352,040 | 11/1967 | Taukin . | |
| 3,422,499 | 1/1969 | Merser . | |
| 3,530,543 | 9/1970 | Desmarais et al. | 24/16 PB |
| 3,590,442 | 7/1971 | Geisinger | 24/16 PB |
| 4,093,288 | 6/1978 | Suzuki | 24/16 PB X |
| 4,136,148 | 1/1979 | Joyce | 24/16 DB X |
| 4,506,415 | 3/1985 | Swift | 24/16 PB |
| 4,616,435 | 10/1986 | Perfect | 40/642 X |
| 4,788,752 | 12/1988 | Kraus et al. | 24/16 PB |

*Primary Examiner*—Kenneth J. Dorner
*Assistant Examiner*—J. Bonifanti
*Attorney, Agent, or Firm*—Sheldon H. Parker

[57] ABSTRACT

An identification tagging device which has a rectangular base unit with raised sides to form a tag receiving region is disclosed. The sides are provided with tabs to retain the removable label. A shaft, which includes a plurality of enlarged areas, extends from one end of the base. A locking device, placed in the base, consisting of a circular section having a diameter slightly greater than the enlarged locking areas, and a smaller circular section, with a diameter less than the enlarged locking areas. An alternate permanent locking device is also provided.

6 Claims, 4 Drawing Sheets

IDENTIFICATION TAG

BACKGROUND OF THE INVENTION

1. Field of the Invention

This invention relates to an improved identification tag for use as a method of placing identification on an animal, plant or item wherein the replaceable information bearing label of the tag is locked to the base portion with the tag shaft. More specifically, the information bearing label is provided with a hole which aligns with the receiving hole in the base portion of the tag and is held in place by locking the tag shaft into the receiving hole.

2. Prior Art

Identification tags are commonly used devices to label various items from dead animals to warehouse merchandise. Due to the numbers involved, the manufacturing and material costs of the tags must be kept to a minimum to allow for economical use. One of the problems associated with keeping the cost to a minimum is securing the information bearing label to the tag. Loss of the information bearing label of the tag negates the purpose of the labeling and most existing methods of retaining the information bearing label to the tag increase the manufacturing an material costs.

U.S. Pat. No. 4,506,415 discloses a device which seals and identifies mail bags and such, which includes a locking mechanism with a locking plug. The ribbed shackle locking mechanism fits into a housing which, when assembled, is inaccessible and prevents the ribbed shackle locking mechanism from reversing direction. The tag holder, as disclosed by Swift, requires a multi-sided device which can be opened and closed in order to prevent the tag from becoming dislodged. This design is relative expensive both in cost of manufacturing and materials.

U.S. Patent to Javkin discloses a luggage tag consisting of a plate and shank, with a locking slot to secure the shank. In one embodiment, the plate is held a double layer device into which information is slid through an end slot. In an alternate embodiment, the plate consists of a pair of rectangular sections, connected by a living hinge, which snap together locking the information within the two sections. In the first embodiment, the information sheet is provided with nothing to prevent it's sliding out the slot where it was inserted. In the second embodiment, although the information sheet is protected, the cost is increased dramatically.

U.S. Pat. No. 3,422,499 illustrates an improved fastening device for securing the one shank end of the device to the other end of the shank, adjacent to the plate or information holder. The Merser patent discloses a novel locking device which could be incorporated as the locking device of the instant disclosure.

U.S. Pat. No. 1,776,074 to Kondolf discloses a flexible connector with a barb type end for non-removably affixing the connector to a tab pocket. The connectors, as disclosed, are made from yarn or wire and are insert holeed into what appears to be a pocket formed from a soft material. The apparent lack of durability of the Kondolf patent would not allow for the use of the device in connection with tagging outdoor items.

The instant invention has overcome the shortcomings of the prior art by allowing a information bearing label of a tag to be retained on the tag until removal is desire.

The information bearing portions of the tags can be constructed to make the entire unit waterproof.

SUMMARY OF THE INVENTION

An identification tagging device which has a rectangular base unit with raised sides to form a tag receiving region is disclosed. The sides are provided with tabs to retain the removable label. A shaft, which includes a plurality of enlarged areas, extends from one end of the base. A locking device, placed in the base, consisting of a circular section having a diameter slightly greater than the enlarged locking areas, and a smaller circular section, with a diameter less than the enlarged locking areas. An alternate permanent locking device is also provided.

BRIEF DESCRIPTION OF THE DRAWINGS

The objects and features of the instant invention will become more apparent from the following drawings when read in conjunction with the specification, wherein.

FI. 1 is a perspective view of the identification tag of the instant invention.

DETAILED DESCRIPTION OF THE PREFERRED EMBODIMENTS

Figure 1:
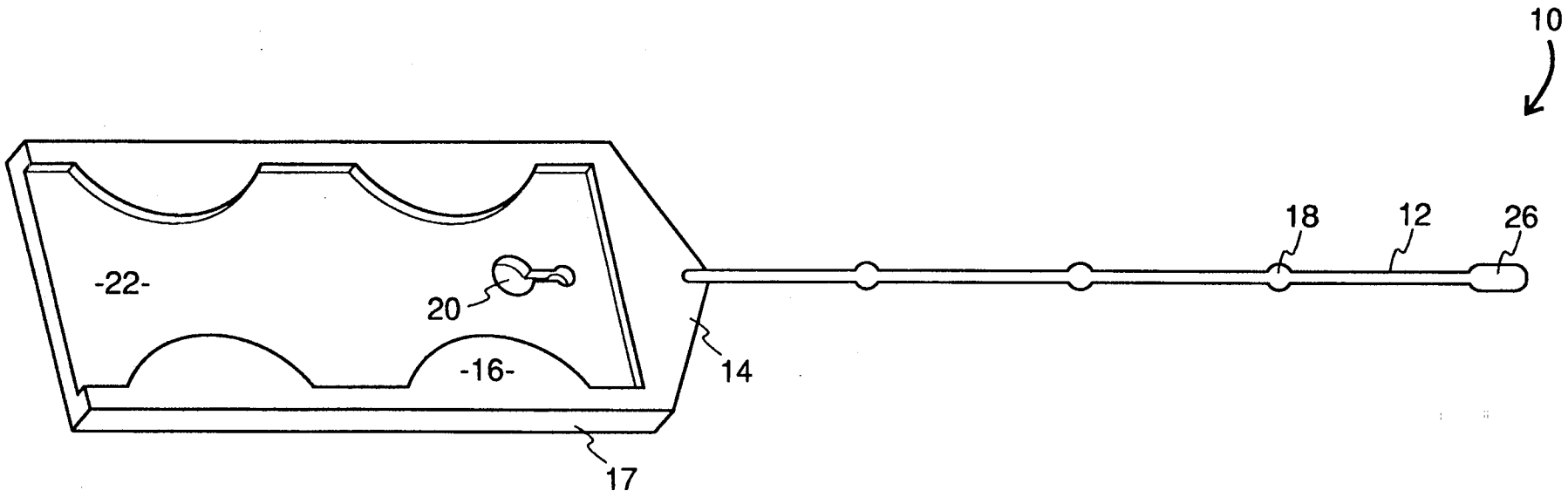
Figure 2:
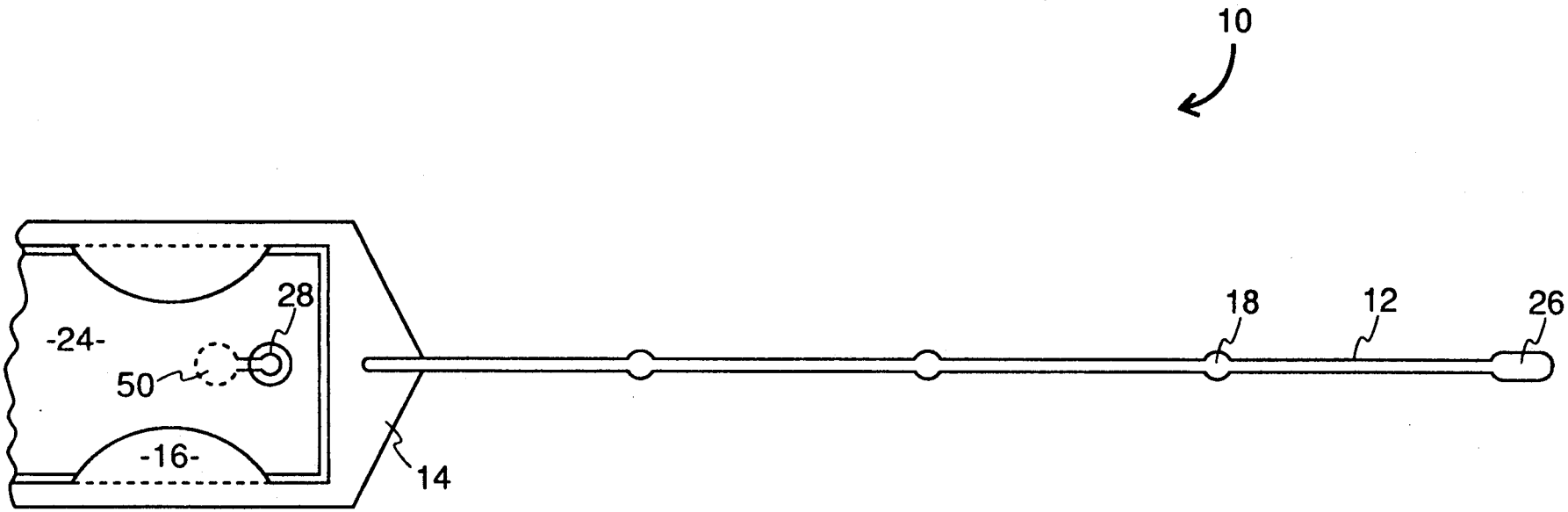
FIG. 2 is a top view of the identification tag of FIG. 1 with the information bearing label insert holeed.

FIG. 1 illustrates the identification tag 10 of the instant invention prior to insertion of the information bearing label 24 of FIG. 2. The identification tag 10 is preferably extruded through methods commonly known in the plastics industry, although other methods of manufacture may be used. The information holder 14 is extruded with a base 22, sides 17 and securing tabs 16, forming a rectangular structure with an open top and end. The spacing between the base 22 and the securing tabs 16 is sufficient to allow for a label 24, shown in FIG. 2, to be easily inserted into the information holder 14. The shank 12 extends from one end of the base 22 and is formed with an elongated end stop 26 and several circular or oval stops 18 positioned along the length of the shaft 12. The elongated end stop 26 and the stops 18 prevent the shaft 12 from withdrawing from the information holder 14 once the shaft has been placed in the locked position. The end stop 26 and the stops 18 are dimensioned to fit through the circular portion 50 of the keyhole insert hole 20 cut into the bottom 22 of the information holder 14. The keyhole insert hole 20 is described in detail in FIG. 5 herein.

The label 24, as shown in FIG. 2, is dimensioned to fit within the sides 17 of the base 22 and preferable does not extend beyond the end of the base 22. The insert hole 28 must have the approximate diameter of circular portion 50 of the base 22 to allow the elongated end stop 26 and stops 18 to pass through without damage to the label 24. During insertion of the shank 12, the insert hole 28 is aligned with the circular portion 50 of the base 22. Once inserted the shank 12 is locked within the keyhole lock 20, as described further herein, moving the label 24 into the position illustrated in FIG. 2 wherein the insert hole 28 is aligned over the locking portion 54 of the keyhole insert hole 20. The label 24 can be manufactured from any desired material, however, it is preferable that it be of a waterproof nature when being used in outdoor tagging.

Figure 3:
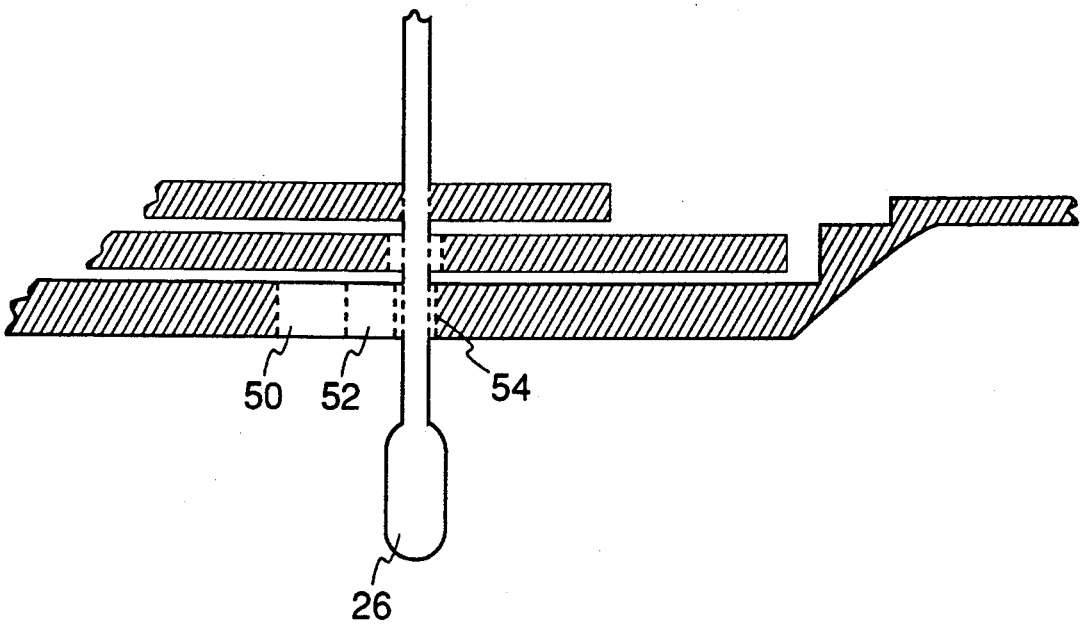
FIG. 3 is a cross sectional side view of the instant disclosure in the locked position.

In FIG. 3 the shaft 12 has been bent around, inserted into the information holder 14 and placed in the locked position. The elongated shaped stop 26 was inserted into circular portion 50 and slid through the 52 and locked in the locking area 54. In this figure, the shaft 12 has been locked using the elongated shaped stop 26, however any of the stops 18 can be used to lock the shaft 12 at the desired length.

Figure 4:
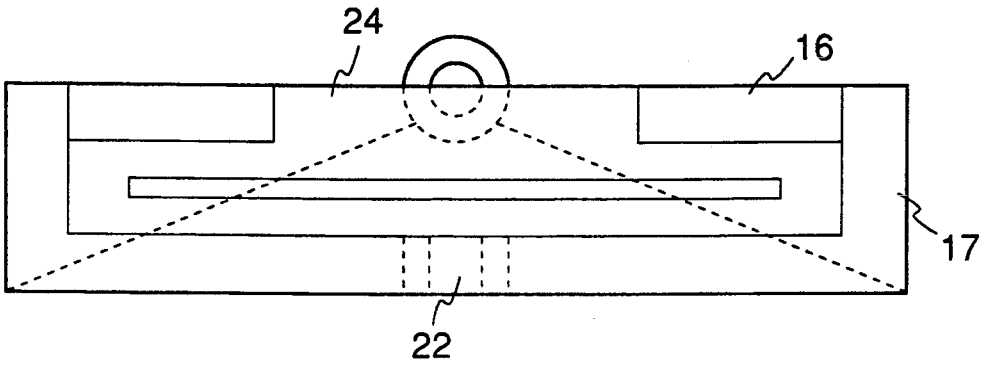
FIG. 4 is an end view of the instant device with the information bearing label insert holeed.

FIG. 4 provides a detailed end view of the information holder 14, further illustrating the spacing between the base 22 and the securing tabs 16. The label 24 is shown inserted and resting on the base 22, kept in position on the base 22 by the securing tabs 16 and sides 17. The dimensioning of the label 24 is important in that it must freely slide into the information holder 14 with sufficient width to prevent the label 24 from falling through the space between the securing tabs 16.

Figure 5:
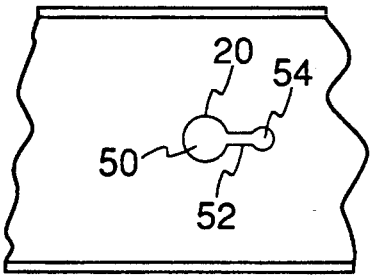
FIG. 5 is a top section of the locking device of the instant device.

The shape of the keyhole insert hole 20, is illustrated in detail in FIG. 5. The circular portion 50 allows the end stop 26 and the stops 18 to pass through to bring the shaft 12 to the desired length. The neck 52 of the keyhole insert hole 20 is dimensioned in conjunction with the diameter of the shaft 12 to create a friction fit between the shaft 12 and the neck 52. The friction fit is required to prevent the shaft 12 from easily sliding through the neck 52 into the circular portion 50 and, thereby allowing the elongated end stop 26 or stops 18 to withdraw from the information holder 14. The locking area 54 is dimensioned to be slightly larger than the diameter of the shaft 12 and substantially smaller than the circular portion 50 to prevent the elongated end stop 26 and stops 18 from passing through once in the locked position. The design of the keyhole insert hole 20 allows the shaft 12 to be placed in the locked position and subsequently unlocked and reused a number of times.

Figure 6:
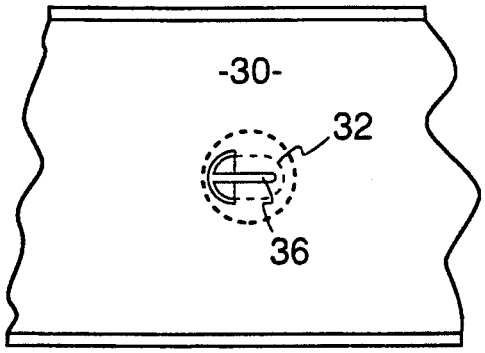
FIG. 6 is an alternate locking device for use with the instant invention.
Figure 7:
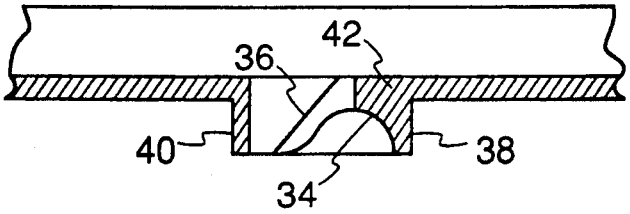
FIG. 7 is a cross section of the locking device of FIG. 6.
Figure 8:
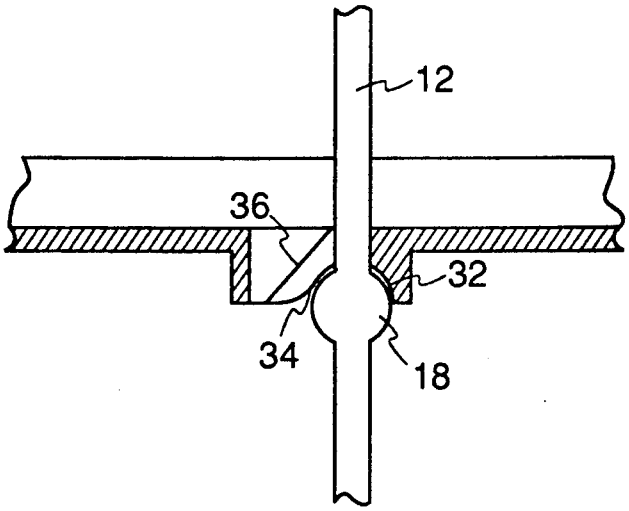
FIG. 8 is a cross section of the locking device of FIG. 6 in a locked position.

An alternate locking system is illustrated in FIGS. 6, 7 and 8 wherein permanent locking device 32 is placed in base 30. The cross section illustrations of FIG. 7 and FIG. 8 illustrate the locking method of this alternate embodiment. The permanent locking device 32 is manufactured with a lip 42 and flange 36, which extends from the lip 42 at a 45 degree angle. Both the flange 36 and lip 42 are centered within the permanent locking device 32. One end of the flange 36 is allowed to float flexibly, either touching or coming short of touching the wall 40. The width of the lip 42 and the flange 36 is substantially less than the diameter of locking device 32 to allow the shaft 12 to be maneuvered around the lip 42 and flange 36. The distance between the lip 42 and the wall 40 is slightly greater than the diameter of the elongated end stop 26 or the stops 18 to allow for the elongated end stop 26 or the stops 18 to pass between the lip 42 and the wall 40. FIG. 8 illustrates the shaft 12 in locked position wherein the stop 18 is placed in the curve 34 locked in place by the support 38 and the flange 36.

What is claimed is:

1. An identification tagging device having a substantially rectangular base unit, said rectangular base unit having an interior region and an exterior region, a first end and a second end, a pair of raised sides and a raised end, said pair of raised sides extending substantially perpendicular from the periphery of said rectangular base unit, between said first end and said second end, said raised end extending perpendicular from said rectangular base between said pair of raised sides at said second end, said pair of raised sides having tag retaining means extending therefrom, said pair of raised sides and said raised end forming said exterior region and enclosing said interior region, a tag receiving means region said tag receiving region being within said interior region;

shaft means, said shaft means extending from and being integral with said second end of said rectangular base unit, said shaft means including a plurality of enlarged spaced locking elements; and locking means, said locking means being in said rectangular base unit between said pair of raised sides, said enlarged locking elements being configured to interact with said locking means to lock said shaft means to said rectangular base unit at anyone of a plurality of positions along said shaft means, whereby when a tag is positioned in said tag receiving region and said shaft means is inserted through said locking means, said shaft means passes through said tag receiving region and said tag, thereby locking such tag in said tag receiving region.

2. The identification tagging device of claim 1 wherein said tag retaining means comprises at least a pair of tabs along each of said sides of said rectangular base unit.

3. The identification tagging device of claim 2 wherein said locking means comprises a shaft receiving hole within said tag receiving means region said locking means being positioned proximate said second end.

4. The identification tagging device of claim 1 said locking means having an insert hole portion, said insert hole portion extending through said rectangular base thereby providing passage for said shaft through said rectangular base;

said raised sides forming right angles with said rectangular base;

a lip portion, said lip portion extending from one point along said interior region of said periphery of said insert hole and extending along a portion of the diameter of said insert hole portion; and a bifurcated flange said bifurcated flange extending from said lip portion at an angle and ending proximate said wall section opposite said one point, said enlarged locking means being able to pass through said bifurcated flange in only one direction.

5. The identification tagging device of claim 4 wherein said locking means is positioned in the tag receiving means region of said rectangular base, said shaft means being inserted through said lip portion thereby locking in place said tag which is in said tag receiving means region.

6. The identification tagging device of claim 5 wherein said lip portion has a surface between said bifurcated flange and said wall, said surface being contoured to receive one of said enlarged locking means.

* * * * *